US005988871A

United States Patent [19]

Bonnet

[11] Patent Number: 5,988,871

[45] Date of Patent: Nov. 23, 1999

[54] AUTOMATED WATCH WINDER AND METHOD OF USING THE SAME

[76] Inventor: Henri Bonnet, 290 Crosstree La., Atlanta, Ga. 30328

[21] Appl. No.: 09/014,730

[22] Filed: Jan. 28, 1998

[51] Int. Cl.[6] ..... G04B 47/00; G04B 3/00; G04D 3/00

[52] U.S. Cl. ..... 368/206; 81/7.5

[58] Field of Search ..... 368/10, 206–213; 73/6; 81/7.5

[56] References Cited

U.S. PATENT DOCUMENTS

| | | |
|---|---|---|
| 443,695 | 12/1890 | Copeland . |
| 650,842 | 6/1900 | Hollar et al. . |
| 1,485,739 | 3/1924 | Thomas . |
| 1,531,026 | 3/1925 | Poole . |
| 2,917,955 | 12/1959 | Leger . |
| 2,926,519 | 3/1960 | Setterberg . |
| 3,620,007 | 11/1971 | Kauffman . |
| 3,774,389 | 11/1973 | Wilken . |
| 4,057,958 | 11/1977 | Wuntch . |
| 5,608,693 | 3/1997 | Richards . |

*Primary Examiner*—Vit Miska
*Attorney, Agent, or Firm*—Jones & Askew, LLP

[57] ABSTRACT

A winding apparatus for winding a mechanical watch while the watch is being stored or displayed, preferably comprises a housing, a wrist-sized mandrel whereupon the watch is placed and held in the housing. A grasping assembly of multiple claws grasps the crown of the watch and is driven by an electric motor. The claws rotate the crown of the watch to automatically wind the watch a predetermined amount and at a periodic interval. A control circuit adjusts the frequency at which the watch is wound as well as the length of time the claws are driven by the motor each time the watch is wound.

24 Claims, 6 Drawing Sheets

AUTOMATED WATCH WINDER AND METHOD OF USING THE SAME

BACKGROUND OF THE INVENTION

1. Field of the Invention

The present invention relates to winding of mechanical watches while the watches are stored or displayed. This invention more particularly pertains to automated winding of watches by engaging the crown of the watch and periodically turning the crown a predetermined amount.

2. Description of Related Art

At present, there are numerous types of watches which do not require manual winding. The most commonly available watches which do not require any winding are battery operated digital watches which run for the life of the battery. Typically, these digital watches may run continuously for years without maintenance by the wearer even while not being worn. These battery operated watches do not need rewinding and, therefore, are not the subject of the present invention.

However, there are also numerous types of watches which are mechanical and do require winding to operate. Most of these mechanical wrist watches may primarily be distinguished by whether they are self-winding or require manual winding by hand to operate. Self-winding mechanical watches operate as long as their is sufficient physical movement to actuate the internal winding mechanisms contained within the watch. The wearer's own natural arm movements actuate the internal winding mechanism of the watch thereby allowing the watch to run without manual rewinding. But while the self-winding watch is not being worn or during periods of inactivity, the watch runs down and will eventually stop. These self-winding watches are then manually rewound by hand to start the watch running again. Additionally, the correct time, moon phases, day of the week and month will also have to be reset though an elaborate sequence which the wearer may find cumbersome to perform each time he wants to wear a fancy watch. However, the present invention eliminates this need.

Mechanical watches which are incapable of self-winding are periodically rewound prior to stopping so that the watch continues to operate. Most high grade watches are hand wound and not automatic. Also, most high grade watches are made of precious metal and are extremely thin for esthetic reasons. In most such watches, there is no room for a self winding rotor. In addition, other complications such as a calendar further increase the thickness of the watch to the degree that the addition of a winding rotor may seriously compromise the esthetic appearance of the watch. Also, high grade precious and expensive watches are seldom worn on a daily basis. An expensive dress watch may only be worn on weekends where the owner may find rewinding and resetting day, month and calendar excessively cumbersome. As a result, he may choose not to wear the watch, therefore, making the investment in a fancy watch impractical.

However, like most other mechanical watches, these manually wound watches also run down if allowed to operate without repeated rewinding. Once the watch stops, it must be rewound in order to begin operating again and the time must also be reset. Also, the fine lubrication in mechanical watches has a tendency to harden and even cease movement if the internal components are not exercised regularly.

As a result of the desire to keep a mechanical watch running while not being used, attempts have been made at providing devices which will rewind a watch and keep it from stopping. Some known devices merely facilitate easy rewinding of the watch while the watch is still being used while others rewind the watch while the watch is being stored and/or displayed. For example, U.S. Pat No. 3,774,389 to Wilken teaches a manual watch stem winder. The watch stem winder may be part of a handle such as a pen or pencil. The winder has a concave shaped end with a series of ribs for receiving the head of a watch stem. Manually rotating the winder with the head of the watch stem in the concave end of the winder will rewind the watch. However, the patent to Wilken does not teach automatic winding of mechanical watches when not in use as does the present invention.

U.S. Pat. No. 4,057,958 to Wuntch teaches an apparatus for winding mechanical self-winding watches when not being worn. The watch is placed over a wrist-sized mandrel such that a revolving shaft driven by a motor rotates the mandrel and the wrist watch together. The rotation of the watch on the mandrel provides sufficient physical movement to actuate the internal winding mechanism contained within the watch. The apparatus disclosed in the patent to Wuntch requires that the watch itself be rotated thereby preventing uninterrupted viewing of the watch. Moreover, the Wuntch invention does not allow for rewinding mechanical watches which are not self-winding.

U.S. Pat. No. 5,608,693 to Richards teaches a nonlinear vibration device for providing vibration to a self-winding mechanical wrist watch when not worn on the wrist. The watch is mounted on a holder which is in turn mounted on springs and driven by a motor. The holder thereby vibrates to mimic human arm movement. The patent to Richards also does not disclose an apparatus for rewinding mechanical watches which are not self-winding.

For the foregoing reasons, what is needed is a winding apparatus which intermittently winds mechanical watches while not being worn such as when being stored and/or displayed. This mechanical watch winder must provide intermittent winding for self-winding watches as well as other types of mechanical watches which are only capable of manual winding by hand. This winding apparatus must also allow the watch to remain stationary so that it may be continuously viewed even while being wound.

BRIEF SUMMARY OF THE INVENTION

The present invention alleviates or solves the above-described problems in the prior art by providing an improved watch winder for automatically winding mechanical watches. The present device satisfies the need to keep the watch stationary for uninterrupted viewing of the watch and the need for continuous functioning to maintain time-keeping accuracy, while able to wind both self-winding watches and watches requiring manual winding.

In accordance with the invention, this object is accomplished by providing a winding apparatus that engages and winds the crown of the watch at periodic intervals for a particular length of time, thereby preventing the watch from running down and stopping.

Generally described, the present invention provides a winding apparatus comprising a power source; means for holding the watch; means for detachably engaging the crown, the detachable engaging means in cooperative alignment with the watch stem when the watch is being held on said holding means; and drive means for rotating the crown. The drive means is powered by the power source and is coupled to the detachable engaging means, whereby the operation of the watch is maintained by automatic winding of the crown of the watch.

In one embodiment, the winding apparatus comprises in combination a power source, a housing, and a wrist-sized mandrel whereupon the watch is placed and held about the periphery of the mandrel. The mandrel is detachably coupled in the housing. A portion of the housing may be formed of transparent material for viewing the watch. The invention in this embodiment further comprises a grasping assembly of multiple claws for receiving and grasping the crown. The grasping assembly is in cooperative alignment with the watch stem when the watch is being held on the mandrel. An electric motor, powered by the power source, is coupled to the grasping assembly. The grasping assembly is driven by the motor such that the grasping assembly rotates the crown of the watch, whereby the operation of the watch is maintained by automatic winding of the crown of the watch.

More particularly, the grasping assembly and a shaft reciprocate in a closure sleeve between extended and retracted positions. The grasping assembly extends forward of the closure sleeve to the extended position in which the claws of the grasping assembly diverge forward and terminate in radially spaced free ends for receiving and grasping the crown of the watch with the grasping assembly. The claws are resiliently moveable radially inward to an engaging position wherein the crown is grasped by the claws. The claws receive and grasp the crown of the watch so that when the motor is turned on the claws will turn the crown, thereby winding the watch.

Even more particularly, the winding apparatus of the present invention comprises a control circuit. The control circuit controls the duration of crown rotation each time the watch is wound. For example, once the motor is on it will be turned off after a predetermined amount of time to control the amount of rotation of the crown. Also, the control circuit controls the frequency of crown rotation to wind the watch. The motor will not turn back on after the watch is wound until a predetermined amount of time has passed. A combination of frequency and duration of the intermittent windings assures that the watch is not wound too tight but is sufficiently wound and will not run down. Preferably, only one of these control parameters is user adjustable.

A winding apparatus formed in accordance with the present invention has a number of advantages. An important advantage of the novel winding apparatus is its ability to indiscriminately wind self-winding as well as other manually wound mechanical watches. Another important advantage is that the winding apparatus maintains continuous operation without over-winding, and provides the user with a nearly fully wound watch when the user removes the watch to wear it.

Accordingly, an object of this invention is to provide an improvement which overcomes the aforementioned inadequacies of the prior art devices and provides an improvement which is a significant contribution to the advancement of the mechanical watch winding art.

Still another object of the present invention is to provide a structurally simple and economical device for automatically winding mechanical watches.

Yet another objective of the present invention is to provide a winding apparatus which maintains the watch being wound in a stationary position such that the watch may be continuously viewed.

The foregoing has broadly outlined some of the more pertinent objects and features of the invention. These should be construed to be merely illustrative of some of the more prominent features and application of the intended invention. Many other beneficial results can be obtained by applying the disclosed invention in a different manner or by modifying the disclosed embodiments. Accordingly, other objects and a more comprehensive understanding of the invention may be obtained by referring to the detailed description of the preferred embodiment taken in conjunction with the accompanying drawings, in addition to the scope of the invention defined by the claims.

It should be appreciated by those skilled in the art that the conception and the disclosed specific embodiments may be readily utilized as a basis for modifying or designing other structures or methods for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the present invention, reference should be directed to the following detailed description taken in conjunction with the accompanying drawings in which.

Similar reference characters refer to similar parts throughout the several views of the drawings.

DETAILED DESCRIPTION OF THE PREFERRED EMBODIMENT

Figure 1:
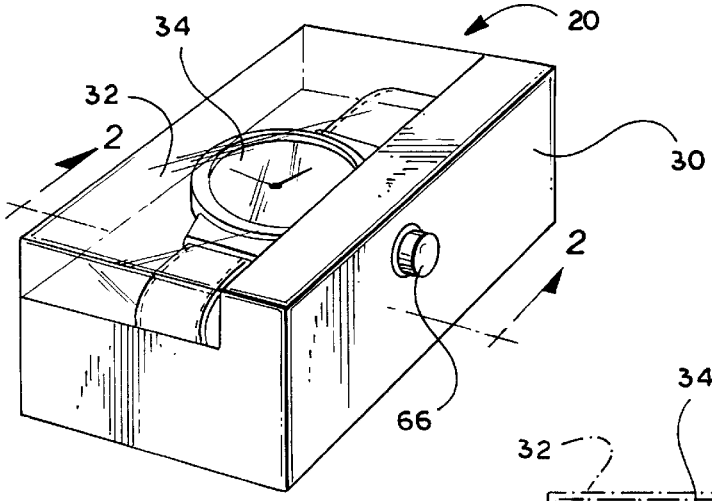
FIG. 1 is a rear perspective view of the preferred embodiment of the winding apparatus of the present invention.

With reference to the drawings, and in particular to FIG. 1 thereof, a new and improved winding apparatus and method embodying the principles and concepts of the present invention and generally designated by the reference number 20 will be described.

Figure 2:
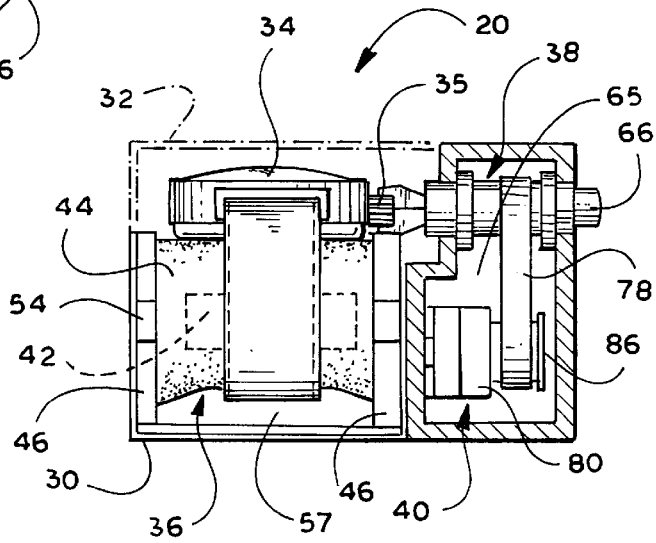
FIG. 2 is a cross-sectional view taken along line 2—2 of FIG. 1.

In the preferred embodiment as shown in FIG. 1, a winding apparatus 20 has a housing 30 and a cover 32. The housing may be made of any suitable material, such as plastic or polished wood, that may have decorative appeal to the consumer. The cover may also be made of plastic. Preferably, the cover is transparent to permit viewing of the inside of the housing. A watch 34 having a crown 35 on a watch stem (not shown) may be positioned in the housing of the winding apparatus and be viewed through the transparent cover. In summary and as shown in FIG. 2, the winding apparatus 20 comprises a housing 30, holding assembly 36 for holding the watch, grasping assembly 38 for detachably engaging the crown of the watch, drive assembly 40 coupled to the grasping assembly for rotating the crown of the watch, and a power source 42 for powering the drive assembly. The watch 34 is held by its strap or band on the holding assembly 36 inside the winding apparatus.

Figure 3:
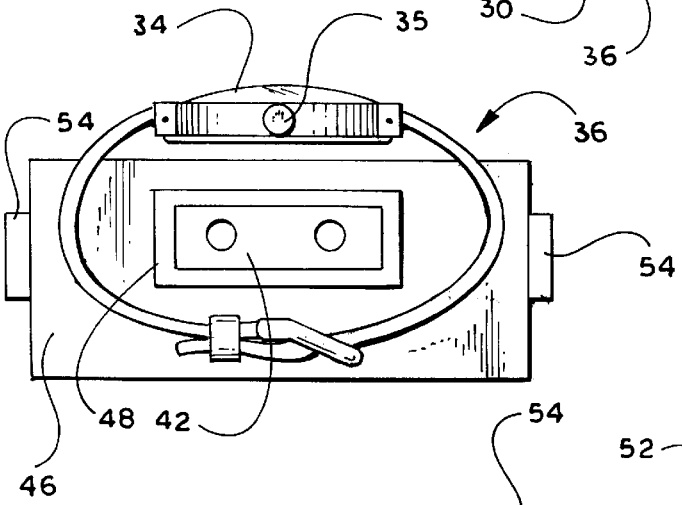
FIG. 3 is a rear side view of the preferred embodiment of the holding assembly of the present invention.
Figure 4:
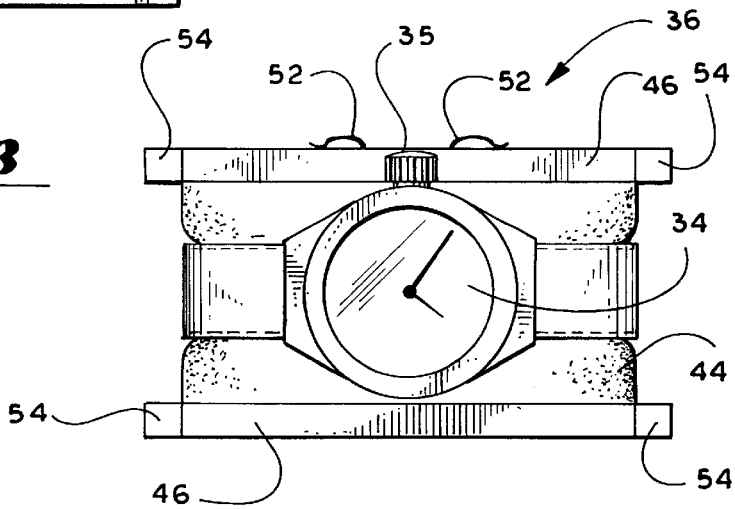
FIG. 4 is a top view of the holding assembly of FIG. 3, holding a watch.
Figure 5:
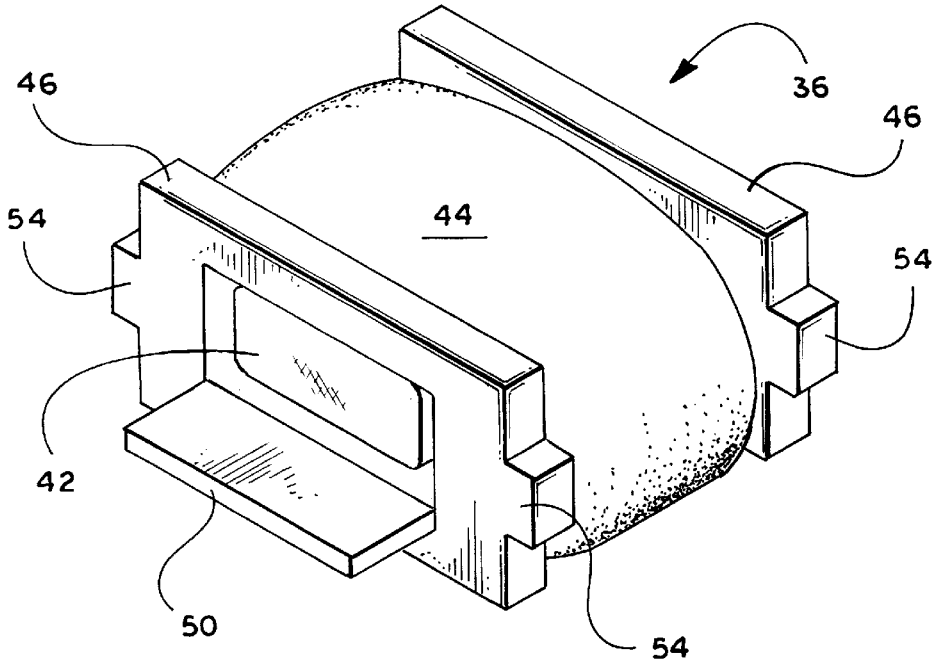
FIG. 5 is a front perspective view of the preferred embodiment of the holding assembly of the present invention.
Figure 6:
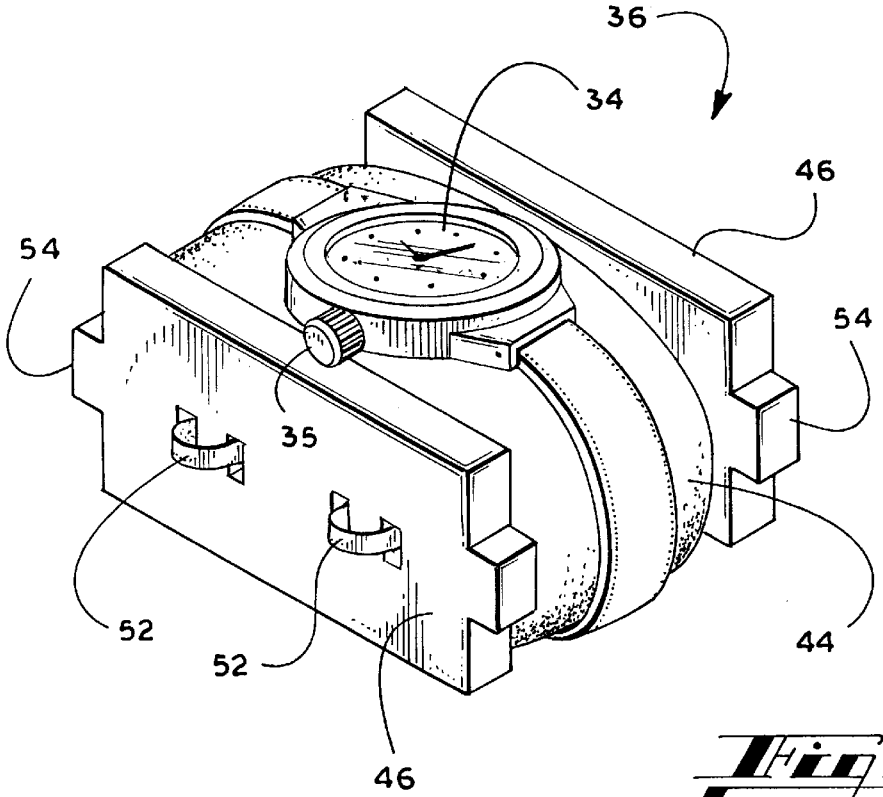
FIG. 6 is a rear perspective view of the holding assembly of FIG. 5, holding a watch.

In the preferred embodiment, the holding assembly 36 is detachably coupled in the housing and holds the watch stationary inside the housing. As shown in FIGS. 3–6, the holding assembly comprises a mandrel 44 positioned between two side walls 46. The mandrel has a cushioned outer lining so that various types of watches may be snugly secured about the periphery of the mandrel. As shown in FIGS. 2, 4 and 6, while the watch is being held on the mandrel, the crown of the watch protrudes over the top edge of one of the side walls to allow the crown to be accessible by the grasping assembly. The grasping assembly is in cooperative alignment with the watch stem of the watch when the watch is being held on the holding assembly. Also, as best shown in FIGS. 3 and 5, the mandrel includes an opening 48 for receiving and substantially enclosing a battery. In the preferred embodiment, the opening is sized for a typical 9 volt battery. The battery may be substantially concealed within the mandrel such that an overall compact appearance may be maintained. As shown in FIG. 5, one of the side walls 46 includes a door 50 for closing the opening to further conceal the battery while the winding apparatus is in use. Also, the terminals of the battery are electrically coupled to a first pair of contacts 52 that are revealed on the side wall opposite the side wall having the door. The contacts 52 are engaged by the battery when the battery is placed in the mandrel. The contacts 52 make electrical contact with the drive assembly 40 as described in further detail below. The winding apparatus is intended to work on a single battery for over 3 years. Alternatively, the winding apparatus may be powered by an external power source rather than a battery. An electrical cord and plug for reception in a wall outlet may be provided for this purpose.

Figure 7:
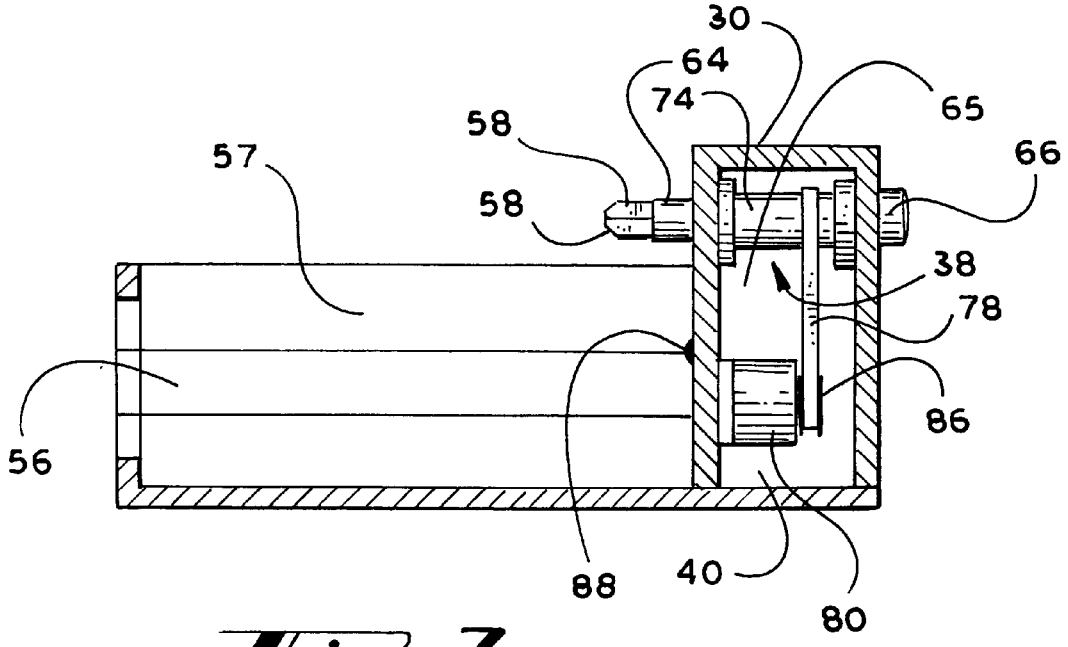
FIG. 7 is a side cross-sectional view of one embodiment of the present invention with the cover and holding assembly removed from the housing.

The side walls 46 also each include a set of tabs 54 extending from opposite ends of each side wall. The tabs are sized to matingly engage with a pair of opposed channels 56. The channels are positioned on the inside of the housing 30 and align with the tabs such that the holding assembly may slide in and out of the housing. One of the channels 56 is best shown in FIG. 7. The holding assembly slides into a space 57, defined by the side walls of the housing, and is secured into place with a detent spring (not shown) as well as by allowing the contacts 52 to engage the contacts 88 as described below. The space 57 is best shown in FIGS. 2 and 7.

Figure 8:
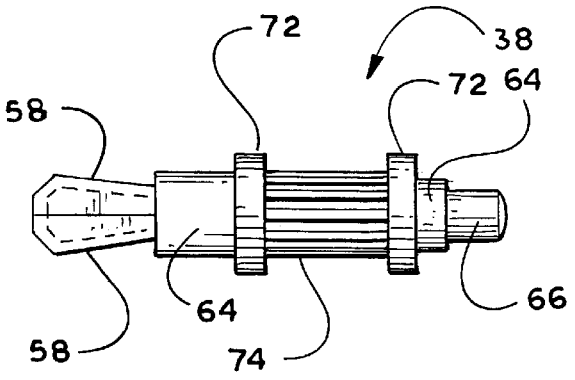
FIG. 8 is a right side view of one embodiment of the grasping assembly of the present invention in the retracted position.
Figure 9:
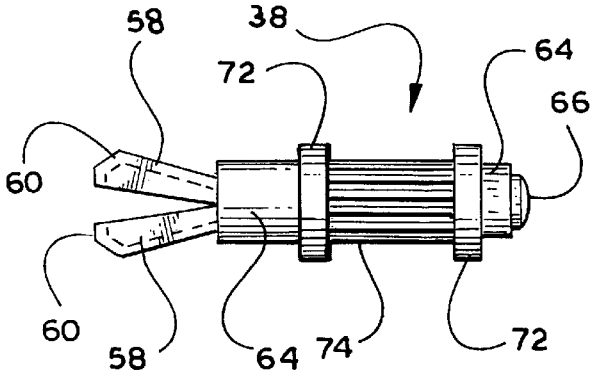
FIG. 9 is a right side view of the grasping assembly of FIG. 8 in the extended position.
Figure 10:
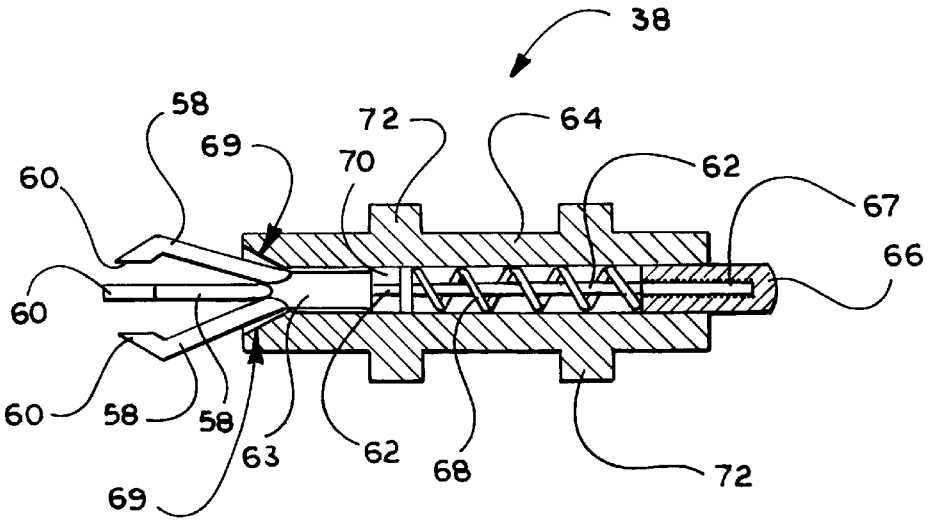
FIG. 10 is a cross-sectional view of the grasping assembly of FIG. 9.
Figure 14:
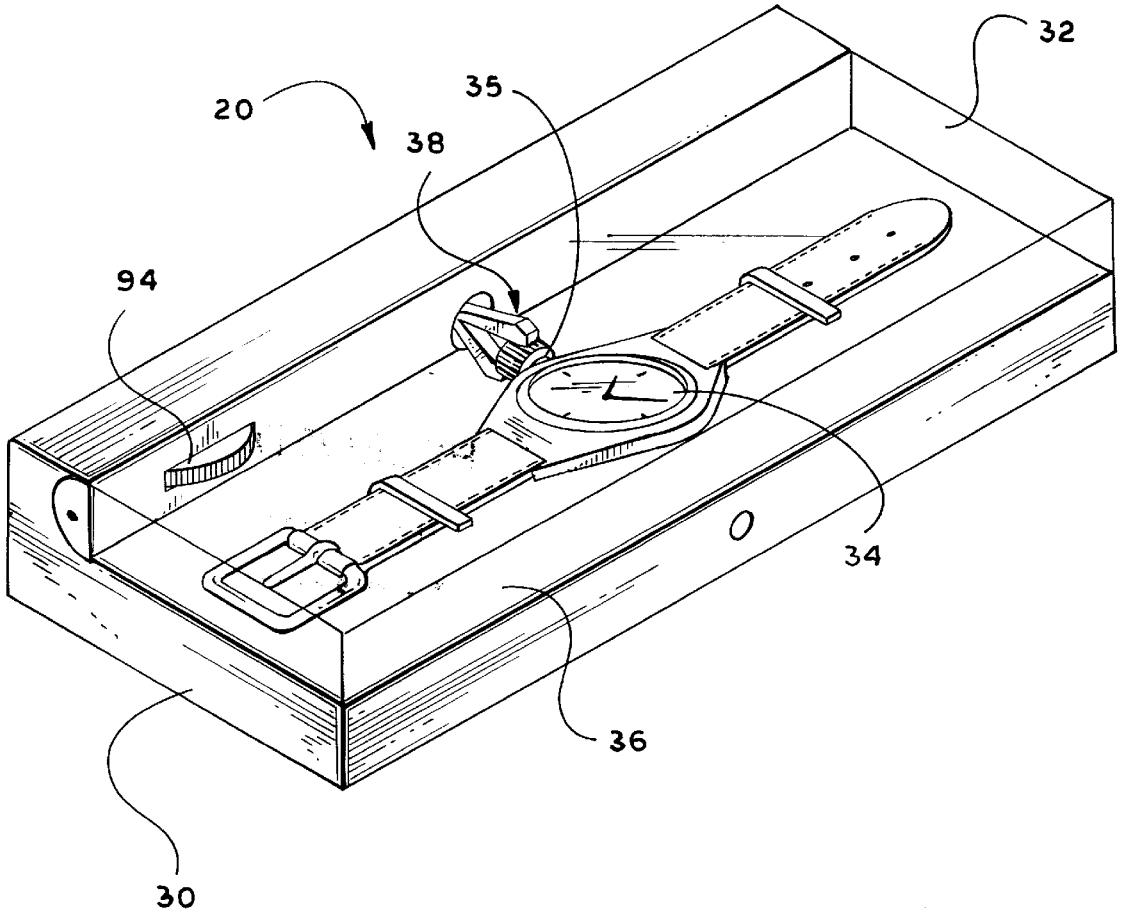
FIG. 14 is a front perspective view of an alternative embodiment of the present invention.

FIGS. 8–10 illustrate one embodiment of the grasping assembly 38 of the present invention for detachably engaging the crown. Preferably, the grasping assembly is made of metal or some other suitable material. As shown in FIG. 8, the grasping assembly comprises multiple claws 58 for receiving and grasping the crown of the watch. Also, FIG. 8 illustrates the claw assembly in the retracted position and FIG. 9 illustrates the extended position wherein the claws diverge forward and terminate in radially spaced free ends 60 for grasping and receiving the crown with the grasping assembly. The claws are resiliently moveable, radially inward to an engaging position, as shown in FIGS. 2 and 14, wherein the crown is grasped by the claws. The inside surface of the claws may be lined with a material such as rubber or urethane that will allow for tighter grasping of the crown of the watch without scratching or marring the precious metal of the crown.

In the preferred embodiment, the grasping assembly further comprises a shaft 62 and a base 63, from which the claws extend, and a closure sleeve 64. The closure sleeve is positioned about the shaft and base as shown in FIG. 10. The claws 58 are coupled to the base 63 as also shown in FIG. 10. In the housing, the closure sleeve extends through a chamber 65 defined by the side walls of the housing. The chamber 65 is best shown in FIGS. 2 and 7. Portions of the claws and the shaft reciprocate longitudinally in the closure sleeve between retracted and extended positions as shown in FIGS. 8 and 9 respectively. The closure sleeve and the shaft cooperate while in the extended and retracted positions to allow resilient expansion and retraction of the claws. In the retracted position, a portion of the claws enter the closure sleeve, forcing the claws to retract. In order to extend the claws out and into the extended position, a button 66, at one end of the shaft and closure sleeve, is depressed. A spring 68 is positioned about the shaft 62 between the closure sleeve 64 such that the shaft is spring-biased inside the closure sleeve. An obturator 70 closes off the inside of the closure sleeve opposite the button. However, the shaft passes through the obturator to allow retraction and extension of the claws. One end of the spring sits up against the obturator while the opposite end of the spring sits up against the inside of the button 66, thereby allowing the spring to bias the shaft within the closure sleeve.

The claws are inwardly biased to receive and grasp the crown in response to movement of the shaft in the closure sleeve when the claw assembly recedes from full extension and into the engaging position when releasing the button 66. When the claws are moving into the engaging position, the spring retracts the shaft causing the claws to close on the crown.

To wind the watch, the closure sleeve 64 is rotated by a mechanism described below. The sleeve in turn rotates the claws 58 by friction created where the claws engage a variable friction, tapered contact surface 69 at the entrance to the sleeve 64. Because the spring 68 urges the parts together, the rotational friction between the claws and the sleeve acts as a clutch.

The button 66 and the shaft 62 are coupled together with threads 67 as shown in FIG. 10. As a result of the threads, the button may be rotated on the end of the shaft such that the tension of the spring may be adjusted, thereby altering the amount of clutching action. Moreover, the spring is interchangeable with other different sized springs. For instance, a smaller spring may be used when rewinding a lady's watch.

A pair of stops 72 each circumscribe the closure shaft. The stops are spaced apart along the length of the closure sleeve 64 and help to maintain engagement between a drive belt 78, described in greater detail below, and the grasping assembly. The stops also assist in the positioning of the grasping assembly within the housing of the winding apparatus. The outer periphery of the stops abut the interior surfaces of chamber 65 in the housing as shown in FIGS. 2 and 7. No bearing is needed as a result of the low number of revolutions required to sufficiently rewind a watch. The housing may be lightly lubricated with silicone grease if necessary. Also, as shown in FIGS. 8 and 9, the closure sleeve includes a geared exterior surface 74. The geared exterior surface reduces slippage between the drive belt 78 and an electric motor 80 while the watch is being wound.

The drive assembly 40 for rotating the crown preferably comprises the belt 78 (preferably a timing belt matched to the cogs of the geared surface 74 of the sleeve 64), electric motor 80 and a pulley 86 as best shown in FIGS. 2 and 7. In the preferred embodiment, the motor is an electric servomotor that includes a second pair of contacts 88, shown in FIG. 7, which engage the contacts 52 and electrically couple the motor to the power source 42 when the mandrel is placed into the space 57 of the housing. The belt is placed about the pulley, attached to the electric motor, and the grasping assembly. The rotation of the motor turns the pulley and the belt to thereby rotate the grasping assembly 38 and the crown of the watch. If desired, the motor can be made to rewind clockwise followed by an equal counterclockwise motion to simulate manual winding. A small green (LED) light will come on showing that the electrical contacts have been made and that the winding apparatus is functioning.

Figure 11:
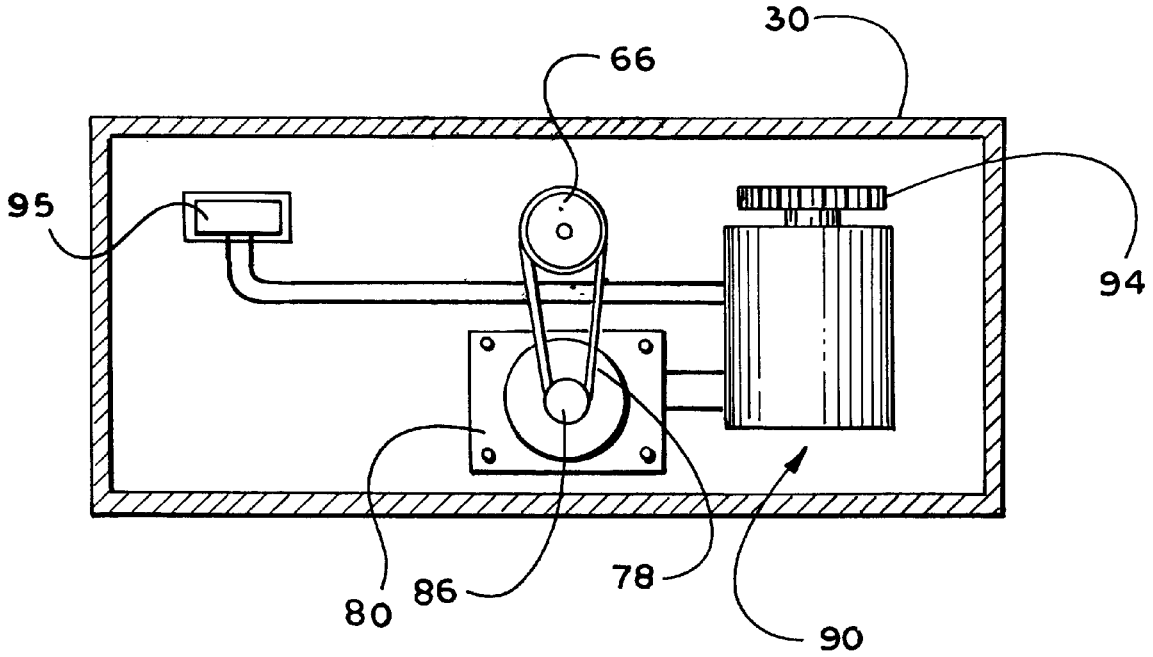
FIG. 11 is a rear cross-sectional view of one embodiment of the winding apparatus of the present invention.
Figure 12:
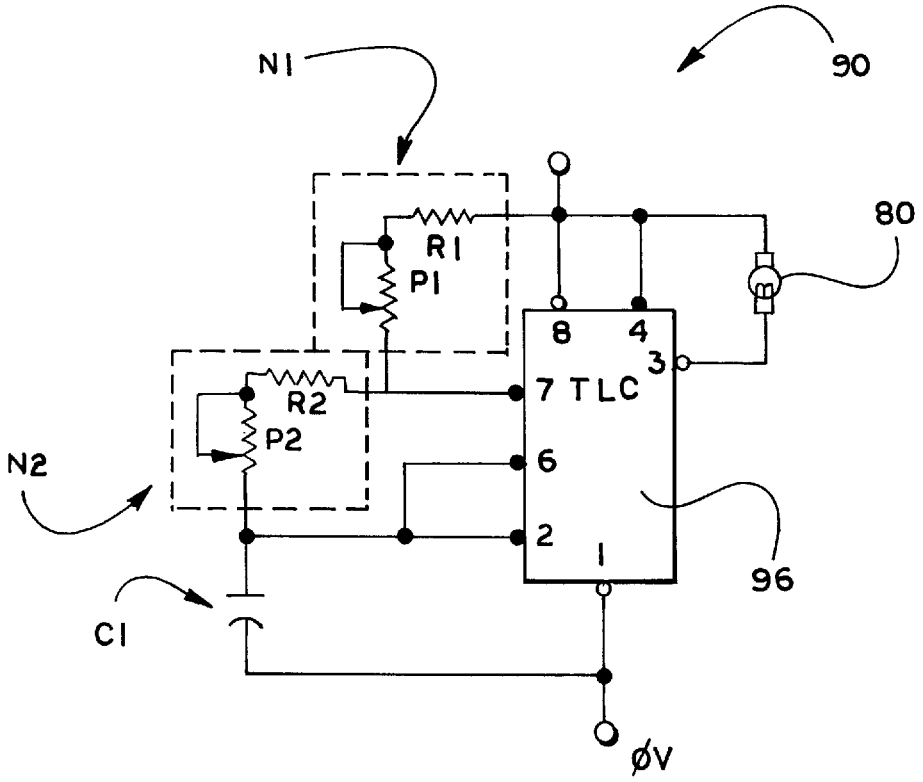
FIG. 12 is an electronic schematic of one embodiment of the control circuit of the present invention.

Another embodiment of the present invention further comprises a control circuit 90. The drive means 40 and the power source 42 are electrically coupled to the control circuit. Each type of mechanical watch has a different spring. Therefore, each type of watch must be wound a different number of turns of the crown or with more or less frequency. The control circuit allows the winding apparatus to be adapted to any particular type of mechanical watch. In the preferred embodiment of the present invention, the electric motor 80 is coupled to the control circuit 90 as shown in FIG. 11. FIG. 12 illustrates one schematic embodiment of the control circuit of the present invention and is discussed in greater detail below.

Figure 13:
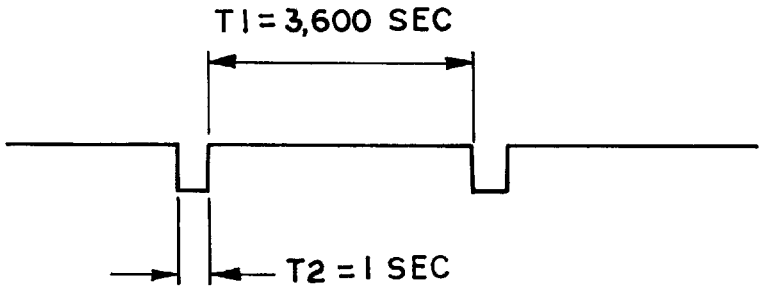
FIG. 13 is a timing diagram of one embodiment of the present invention where the watch is wound every 3,600 seconds ($T_1$) for 1 second ($T_2$)

The control circuit controls the operation of the winding apparatus. Referring to FIG. 13, the control circuit controls the frequency of crown rotation, $T_1$, to wind the watch. In other words, the interval of time, $T_1$, between each successive instance of watch winding is controlled by the circuit. Depending on how much the watch is wound at each occurrence, a longer interval of time may pass before the watch is rewound.

Also, the control circuit controls the duration of crown rotation, $T_2$, each time the watch is wound. For example, as a result of the electric motor being turned on, the grasping assembly, while grasping the crown of the watch to be wound, rotates and thereby winds the watch. In this instance, the control circuit adjusts the length of time, $T_2$, the grasping assembly is driven by the motor. In the preferred embodiment, either the amount which the watch is wound or the frequency which the watch is wound is controlled. Both parameters could be controlled, but only one need be variable. It is preferable, to adjust the frequency $T_1$ of rewinding the watch.

These parameters can be preset at the factory when a new watch is sold in conjunction with the present invention. Variable resistors within the control circuit adjust each of these timing parameters. As shown in FIG. 11, an adjustment wheel 94 is coupled to the control circuit to adjust one of these resistors. The control circuit also includes an on/off switch 95 for controlling the operation of the control circuit in conjunction with the motor.

FIG. 12 is a typical schematic for the control circuit 90. In this embodiment, the circuit comprises first and second resistive networks $N_1$ and $N_2$ in series. In the first resistive network, $N_1$, is a first resistor $R_1$ of 470 kΩ in series with a first potentiometer $P_1$ of 1 MΩ. In the second resistive network, $N_2$, is a second resistor $R_2$ of 220 Ω in series with a second potentiometer $P_2$ of 5 kΩ. The first resistive network is connected in parallel with input 7 of a timing logic chip 96 and the second resistive network. The output of the second resistive network is connected in parallel with inputs 2 and 6 of the timing logic chip 96 and a capacitor $C_1$ having a capacitance of 4700 $\mu$f. A 9 volt input source, battery 42, is connected in parallel with the first resistive network and inputs 8 and 4 on the timing chip as well as the motor 80. The interaction between the networks $N_1$ and $N_2$ in combination with the timing chip 96 cooperate to set up the two variable timing periods. Hence, by varying $P_1$ and $P_2$, one can affect $T_1$ and $T_2$ respectively. FIG. 13 is a timing diagram of one embodiment of the present invention where $T_1$ is 3,600 seconds and $T_2$ is 1 second. Thus, in this example, the watch is wound every hour by rotating the crown of the watch for 1 second. However, $T_1$ may be adjustable from 1,800 seconds to 3,600 seconds and $T_2$ may be adjustable from 1 second to 10 seconds. Longer or shorter times may be selected, if desired.

The total resistance $R_{total}$ for a network N is calculated by the following formula:

$$R_{total}=T/(C(\text{Const.})),$$

where T=time in seconds, R=resistance in ohms, C=capacitance in farads, and Const.=chip trigger constant. For network $N_1$, if $T_1$=1 hour which is 3,600 seconds, $C_1$=0.0047 farads, and if the timing logic chip is provided with a Const.=0.693, then $R_{total}$ is approximately 1.10 million ohms. Thus, in order to have approximately 1 hour between windings, $R_{total}$ for the network $N_1$ would have to be approximately 1.10 million ohms. The potentiometer $P_1$ and the resistor $R_1$ may then be selected to effect the desired total resistance $R_{total}$.

FIG. 14 illustrates an alternative embodiment of the present invention. The primary distinguishing factor in this particular embodiment is that the holding assembly 36 allows the watch to be held substantially flat against the holding assembly. In this embodiment, mechanical watches that unbuckle and allow the straps to lie outstretched are preferred. Also, the battery is concealed in the winding apparatus underneath the holding assembly. The watch is held into place on the holding assembly with a pair of resilient clips 98. An end of each of the clips is secured to the holding assembly and each of the straps of the watch band then pass underneath one of the clips to hold the watch in place within the winding apparatus. As shown in FIG. 14, a portion of the adjustment wheel 94, for adjusting the amount which the watch is wound as described above, is revealed from within the housing and is accessible by lifting or removing the cover 32. The adjustment wheel may have markings visible to the user which indicate the degree of adjustment available for an adjustable timing parameter. An adjustment table may be provided listing the name and model of a watch corresponding with each setting of the adjustment wheel.

The use of the winding apparatus 20 as described above constitutes an inventive method of the present invention in addition to the winding apparatus itself. In practicing the method of automatically winding a mechanical watch while being stored or displayed with the winding apparatus 20 as described above, the steps include holding the watch in a stationary position on the holding assembly 36 as described above. The method then includes the step of engaging the crown of the watch with the grasping assembly 38 while the watch is being held as described above. The method also includes the step of rotating the crown of the watch by turning the grasping assembly with a drive assembly 40 as described above, thereby maintaining the operation of the watch by automatically winding the crown of the watch.

In one embodiment, the method of the present invention also comprises the step of adjusting the length of time the crown is rotated, thereby controlling the amount the crown of the watch is rotated to wind the watch each time. Also, the method of the present invention comprises the step of adjusting the interval of time between successive rotations of the crown when winding the watch, thereby controlling the frequency which the watch is wound. In the preferred embodiment, only one of these timing adjustments is practiced at one time.

In order to adapt the winding apparatus to a watch which needs rewinding, the watch should be first rewound by hand and adjusted to the correct time. While rewinding the watch, the number of turns to sufficiently rewind the watch by hand should be determined. The winding apparatus is then set to provide the desired amount of rewinding by adjusting the adjustment wheel 94. The watch is then placed on the watch holder which is, in turn, placed in the winding apparatus. The button 66 is depressed to extend the claws toward and around the crown of the watch. Then the button is released, and while the claws are retracting, they grasp the crown of the watch. Because the claws are spring-biased, the claw assembly adjusts automatically to crowns of varying size. The winding apparatus is then turned on and the watch is allowed to partially run down. From this point on, the winding apparatus, at periodic intervals, rewinds the watch by turning on the motor in order to keep the watch continuously wound and displaying the correct time. For example, the winding apparatus will turn the crown automatically by one full turn every hour or a fraction of a turn every hour depending on the setting of the adjustment wheel. No watch can be over-wound since the crown grabber is spring loaded and is designed to act as a clutch. The claws will slip in the sleeve of the winding apparatus such that the watch will not become overwound. Turning the button 66 adjusts the spring tension. Also, while the watch is being stored or displayed in the winding apparatus, it may occasionally be removed, worn, and replaced. The watch should be sufficiently wound when returned to the winding apparatus.

The present invention has been illustrated in great detail by the above specific examples. It is to be understood that these examples are illustrative embodiments and that this invention is not to be limited by any of the examples or details in the description. Those skilled in the art will recognize that the present invention is capable of many modifications and variations without departing from the scope of the invention. Accordingly, the detailed description and examples are meant to be illustrative and are not meant to limit in any manner the scope of the invention as set forth in the following claims. Rather, the claims appended hereto are to be construed broadly within the scope and spirit of the invention.

Now that the invention has been described,

What is claimed is:

1. A winding apparatus for winding a mechanical watch, the watch having a crown on a watch stem for winding the watch, said winding apparatus comprising, in combination:

a power source;

means for holding the watch;

means for detachably engaging the crown, said detachable engaging means in cooperative alignment with the watch stem when the watch is being held on said holding means; and drive means for rotating the crown, said drive means powered by said power source and coupled to said detachable engaging means, whereby the operation of the watch is maintained by automatic winding of the crown of the watch.

2. The winding apparatus of claim 1 further comprising a control circuit, said drive means and said power source electrically coupled by said control circuit.

3. The winding apparatus of claim 2 wherein said control circuit controls the duration of crown rotation each time the watch is wound.

4. The winding apparatus of claim 2 wherein said control circuit controls the frequency of crown rotation to wind the watch.

5. The winding apparatus of claim 1 wherein said drive means is an electric motor and said power source is a battery.

6. The winding apparatus of claim 1 wherein said holding means is a wrist-sized mandrel whereupon the watch is placed and held about the periphery of said mandrel.

7. The winding apparatus of claim 6 wherein said mandrel includes an opening and said power source is a battery, said opening is sized to receive said battery and said battery is substantially enclosed by said mandrel when said battery is received in said opening.

8. The winding apparatus of claim 7 wherein said mandrel includes a first pair of contacts that are engaged by said battery when said battery is placed in said mandrel.

9. The winding apparatus of claim 8 further comprising a housing, said mandrel detachably coupled in said housing, and wherein said drive means includes a second pair of contacts that engage said first pair of contacts when said mandrel is placed in said housing.

10. The winding apparatus of claim 1 wherein said detachable engaging means comprises a grasping assembly of multiple claws diverging forwardly and terminating in radially spaced free ends for receiving and grasping the crown with said grasping assembly, and said claws being resiliently moveable radially inward to an engaging position wherein the crown is grasped by said claws.

11. The winding apparatus of claim 10 wherein said grasping assembly further comprises a shaft and a closure sleeve positioned about said shaft, said shaft and said claws longitudinally reciprocating in said closure sleeve between extended and retracted positions, said closure sleeve and said shaft cooperating while in said extended and retracted positions to allow resilient expansion and retraction of said claws, whereby a portion of said claws enter said closure sleeve while in said retracted position.

12. The winding apparatus of claim 11 wherein said claws inwardly bias to receive and grasp the crown in response to movement of said shaft in said closure sleeve.

13. The winding apparatus of claim 11 wherein said closure sleeve includes a geared exterior surface.

14. The winding apparatus of claim 11 wherein said shaft is spring-biased in said closure sleeve.

15. The winding apparatus of claim 1 wherein said detachable engaging means and said drive means are coupled by a belt.

16. The winding apparatus of claim 1 further comprising a housing, said holding means detachably coupled in said housing and holding the watch stationary in said housing.

17. The winding apparatus of claim 16 wherein at least a portion of said housing is formed of transparent material for viewing the watch.

18. A method for automatically winding a mechanical watch while being stored or displayed, the watch having a crown for winding the watch, said method comprising the steps of:

holding the watch in a stationary position on a holding assembly;

engaging the crown of the watch with a grasping assembly while the watch is being held; and rotating the crown of the watch by turning said grasping assembly with a drive assembly, thereby maintaining the operation of the watch by automatically winding the crown of the watch.

19. The method of claim 18 further comprising the step of adjusting the length of time the crown is rotated, thereby controlling the amount the crown of the watch is rotated each time the watch is wound.

20. The method of claim 18 further comprising the step of adjusting the interval of time between successive rotations of the crown when winding the watch, thereby controlling the frequency which the watch is wound.

21. A winding apparatus for winding a mechanical watch, the watch having a crown on a watch stem for winding the watch, said winding apparatus comprising, in combination:

a power source;

a housing;

a wrist-sized mandrel whereupon the watch is placed and held about the periphery of said mandrel, said mandrel detachably coupled in said housing;

a grasping assembly of multiple claws for receiving and grasping the crown, said grasping assembly in cooperative alignment with the watch stem when the watch is being held on said mandrel;

an electric motor coupled to said grasping assembly and powered by said power source, said grasping assembly driven by said motor such that said grasping assembly rotates the crown of the watch, whereby the operation of the watch is maintained by automatic winding of the crown of the watch.

22. The winding apparatus of claim 21 further comprising a control circuit adapted to adjust the length of time said grasping assembly is driven by said motor, said motor electrically coupled to said control circuit, thereby controlling the amount the crown of the watch is rotated each time the watch is wound.

23. The winding apparatus of claim 21 further comprising a control circuit adapted to adjust the interval of time between successive watch windings, said motor electrically coupled to said control circuit, thereby controlling the frequency which the crown of the watch is wound.

24. The winding apparatus of claim 21 wherein said power source is a battery substantially enclosed by said mandrel and said drive means includes contacts that are engaged by said battery when said mandrel is placed in said housing.

* * * * *